United States Patent [19]

Brause et al.

[11] 4,290,367

[45] Sep. 22, 1981

[54] OVERHEAD CONVEYOR

[75] Inventors: Joachim Brause, Krefeld; Thomas Gerhard, Viersen; Manfred Keller, Duisburg; Henry Olszok, Krefeld, all of Fed. Rep. of Germany

[73] Assignee: Waggonfabrik Uerdingen A.G., Krefeld, Fed. Rep. of Germany

[21] Appl. No.: 971,077

[22] Filed: Dec. 19, 1978

[30] Foreign Application Priority Data

Apr. 29, 1978 [DE] Fed. Rep. of Germany ..... 2819068

[51] Int. Cl.[3] ..... B61B 3/00

[52] U.S. Cl. ..... 104/105; 104/130

[58] Field of Search ..... 104/96, 105, 130, 247

[56] References Cited

U.S. PATENT DOCUMENTS

| | | | |
|---|---|---|---|
| 3,274,953 | 9/1966 | Babson | 104/96 X |
| 3,356,039 | 12/1967 | Fonden et al. | 104/130 |
| 3,593,665 | 7/1971 | Marty | 104/130 X |
| 3,593,668 | 7/1971 | Adams | 104/105 X |
| 3,783,793 | 1/1974 | Perrott et al. | 104/130 |
| 3,811,383 | 5/1974 | Butzow | 104/130 |
| 3,830,163 | 8/1974 | Wright et al. | 104/105 |
| 3,841,225 | 10/1974 | Johnson | 104/130 |
| 3,874,299 | 4/1975 | Silva et al. | 104/105 X |

FOREIGN PATENT DOCUMENTS

| | | | |
|---|---|---|---|
| 1371511 | 10/1974 | United Kingdom | 104/130 |
| 1493577 | 11/1977 | United Kingdom | 104/130 |

OTHER PUBLICATIONS

Marten et al., "Die H-Bahn als Automatisches Nahverkehrs-System für den Linienverkehr", *Verkehr und Technik*, Copies 1-3, 1977, p. 4.

*Primary Examiner*—Randolph A. Reese
*Attorney, Agent, or Firm*—Michael J. Striker

[57] ABSTRACT

The overhead conveyor comprises a main track and a branch track connected to the main track in a switch point, the tracks having a shape of a box-like beam with a longitudinal slit in its bottom flange for suspending a trolley carriage, the carriage supporting a rocking lever having at its ends guiding rollers, the operation of the switch point being safeguarded via tiltable tongues arranged on the lower flange of the track and cooperating with slide shoes provided on the ends of the rocking lever, and by means of locking rails attached to the side walls of the track to lock the rocking lever in the desired angular position; the ends of the rocking lever further support safety noses each having an inclined surface of a length sufficient for bridging the gap between the ends of the inclined tongues and the beginning of the locking rail when the slide shoe still engages the end portion of the safety tong.

7 Claims, 4 Drawing Figures

OVERHEAD CONVEYOR

BACKGROUND OF THE INVENTION

The invention relates generally to an overhead conveyor, and more particularly it relates to a conveyor of the type which has a track installation with at least one track switch point, a trolley carriage suspended on the installation, switch point operating means including guiding rails and interlocking rails secured to the track installation, a switch roller arranged on a lever which is pivotably supported on the trolley carriage, the rollers cooperating with the guiding and interlocking rails, and being controlled by an adjustment device arranged on the carriage and being responsive to control signals to angularly offset the lever according to the desired direction of the carriage, and a safety device including tiltable tongues arranged on the track installation in front of the interlocking rails and controlled by the adjustment device for the lever to provide a sloping surface in the direction of travel of the carriage.

An overhead conveyor of the above-described type is described for example in a special issue of the magazine "Verkehr und Technik", 1977, copies 1–3. The described switch points and overhead track installations for the trolley carriage consist of box-like beams defining at its lower flange a longitudinal slit through which suspension means between the trolley and the carriage such as for example passenger cars, are directed. The track switch due to the diverging longitudinal slot in the branch track defines a switch point gap and consequently in order to stabilize the position of the carriage when passing through this gap it is necessary to provide switch guiding rails on the track installation and switch guiding rollers in the carriage cooperating with the guiding rails. These guiding rollers are tiltably supported to engage the desired guiding rails so that when the carriage approaches the switch point the desired direction can be selected. Usually, the guiding rollers are arranged in pairs on free ends of cooperating rocking levers pivotably supported on the carriage and controlled into a desired angular position by an adjustment device of the carriage. In order to monitor and also to adjust precisely the angular position of the rocking levers in accordance with the desired direction of advance of the carriage there is also provided a mechanically operated safety device. This known safety device consists of tiltable tongues arranged in the range of the track installation before the switch point, the tongues being operable to be alternately swung up to provide wedge like sloping surfaces cooperating with the raised guiding rollers. The sloping tongues can be also rigidly arranged on the tracks to safeguard the advance of the carriage and prevent its deflection in the undesired direction. The two switching possibilities before a track switch point necessitate the provision of pairs of these safety tongues whereby the tongues in each pair are alternatively activated into the sloping position. In the event that the guiding rollers assume accidentally a wrong position for example due to an erroneous electrical control signal transmitted to the adjustment device, the independently adjusted sloping tongues insure that as soon as slide shoes provided on the rocking levers engage the sloping surfaces the guiding rollers are mechanically swung up into the correct switching position independently of the position of the adjustment device on the carriage. The correct position of the switch guiding rollers no matter whether adjusted by the adjustment device on the carriage or by the safety tongues on the track is further insured against unintentional retraction into an incorrect switching position before the switch point by interlocking rails which in the prior art construction form with the guiding rails a channel surrounding the guiding rollers.

In this practicable prior art conveyor system improvement with respect to the safety of the switching action of the carriage are still desirable. For example, due to the elastic suspension of the trolley carriage the level of the aforedescribed switch point guiding parts arranged in the trolley carriage is dependent on the momentary load condition of the cabin; as a result, the slide shoe on the rocking levers engage the assigned safety tongues at different contact points and consequently the rocking levers with the supported guiding rollers are swung up at different angles. For example if the trolley carriage is unloaded and the construction tolerances accumulate accidentally in an undesired direction, this switching angle of the rocking lever can be so small that the switch point guiding rollers or other parts of the rocking lever collide with the ends of the interlocking rail. Furthermore, in view of the fact that the guiding rollers at one side of the carriage before the switch point have to be swung down into the effective range of the interlocking rails and at the same time the guiding rollers on the other side of the carriage have to be swung up out of the range of the interlocking rails, there must be provided a free space extending in the direction of the travel of the carriage between the end of the safety tongues and the beginning of the interlocking rails. Because of this free spacing however the possibility remains that the correctly inclined nonetheless unlocked rollers can be still tilted for example by means of a false control impulse to reverse its angular position before the rollers reach the locking rails.

SUMMARY OF THE INVENTION

It is therefore a general object of the present invention to overcome the aforementioned disadvantages.

More particularly, it is an object of this invention to provide an overhead conveyor of the above-described type which is improved as to the reliability and safety of its operation.

A further object of this invention is to provide a safety device for the trolley carriage which initials safe switching operation independently from construction tolerances and from the load of the carriage.

An additional object of the invention is to provide such an improved overhead conveyor which guarantees the correct interlocking or guiding rollers by locking rails.

In keeping with these objects and with others which will become apparent hereafter, one feature of the invention resides, in an overhead conveyor of the above described type, in the provision of locking noses on the rocking lever for the guiding rollers, the noses defining sloping surfaces of a predetermined length sufficient for overlapping the beginning of interlocking rails in the position of rocking roller in which its sliding shoes still engage the end portion of the sloping surface of the safety tongue so that even in the case of an error actuation signal for the rocking lever when the sliding shoes disengage the tongue, the interlocking rails during the advance of the trolley carriage engage the safety noses in the correct position of the rocking lever.

In order to insure maximum stability of the trolley carriage both in the horizontal and in the vertical plane in the range of the switch point, it is recommended to provide on the carriage two rocking levers arranged at a distance one above the other. This arrangement of superposed rocking levers has been already devised in the known previously discussed overhead conveyor whereby the rocking levers arranged in longitudinal direction are connected through a connecting tube and in vertical direction by means of a vertical coupling rod. The longitudinal coupling tube has the advantage that only one driving member is necessary for imparting rocking movement to the front and rear levers. The disadvantage of this prior art arrangement is the fact that the relatively long connecting tube causes due to its torsional elasticity the swinging of the front and rear rocking levers to different angular positions. The structure of this invention makes it possible to dispense with the longitudinal connecting tube for the consecutively arranged rocking levers and insures a reliable running of the trolley carriage in the desired direction at the switch point by providing both the leading rocking lever and the trailing rocking lever with sloping safety noses whereby the assigned driving shoes cooperating with the safety tongues are symmetrically arranged in a vertical plane relative to the track.

According to another feature of this invention, the sliding shoes have calotte-like configuration and are mounted on respective ends of the rocking lever with its round surface facing the cooperating safety tongues.

The particular advantage of the arrangement of this invention resides in the fact that the rocking levers supporting the guiding rollers are held in their correct position also in the transition range between the end of the safety tongues and the beginning of the locking rails; only by the bridging of the gap between the safety tongues and locking rails is insured the real safety of the switching operation. In addition, it is insured that the rocking lever assembly independently from the deviation of permissible manufacturing tolerances of the track insulation and from the loading condition of the carriage are reliably offset into such a position in which an exact cooperation of the rollers and of the guiding rails is guaranteed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
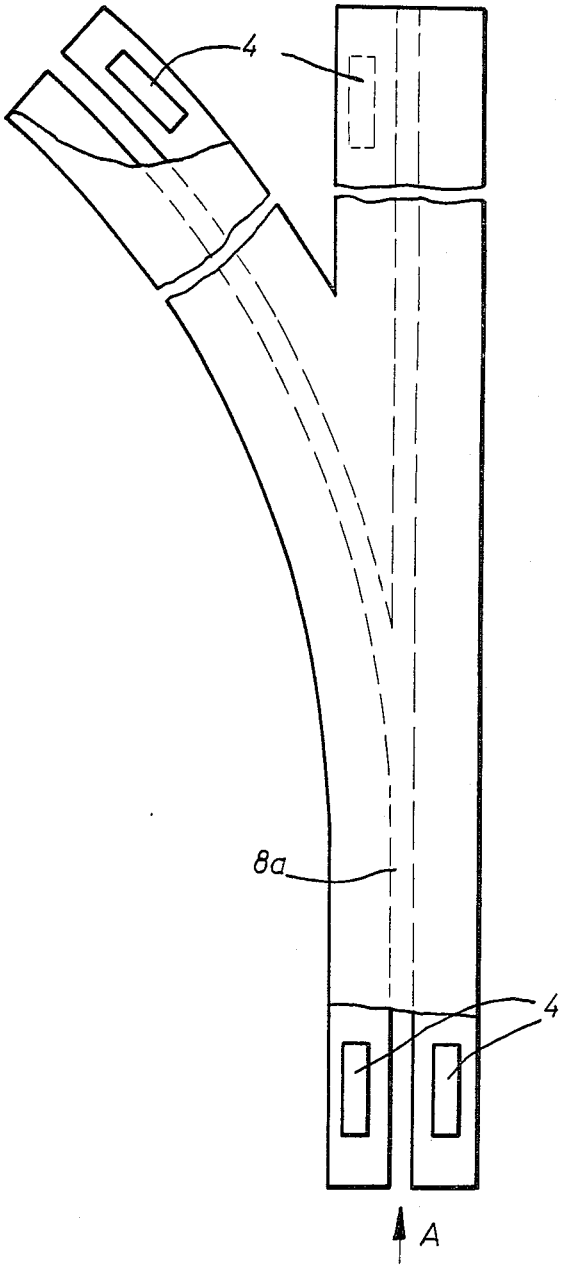
FIG. 1 is a schematic top view of a portion of overhead track installation including a switch point.

FIG. 1 shows schematically the lay-out of parts of an overhead track installation for a suspended conveyor including a branch track farmed out from the main track at a switch point.

Figure 2:
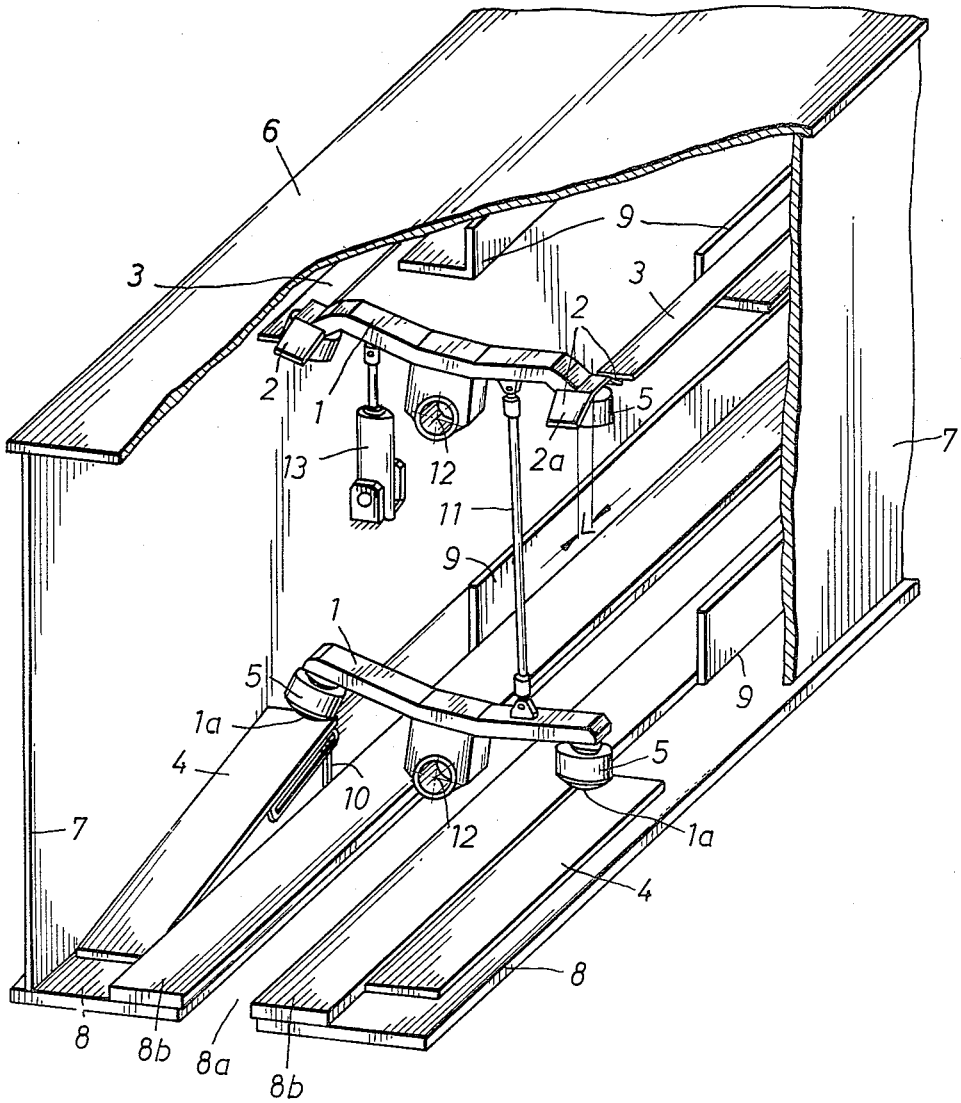
FIG. 2 is a perspective view in the direction of arrow A in FIG. 1 of a cut-away portion of the overhead conveyor of this invention in the region before a switch point.

FIG. 2 illustrates a section of this track installation immediately in front of the switch point where the branch track and the main track join each other. The track installation is composed of a box-like beam defining an upper flange 6, side walls 7 and a lower flange 8 divided by a central slot **8*a* for the suspension member of a trolley carriage. In the region of the switch point, the track installation supports two pairs of guiding rails 9, one pair being arranged at the bottom flange 8 and the other pair being arranged at the side walls 7 near the top flange 6. On the lower flange are also supported runway rails 8*b* extending at both sides of slot 8*a* and parallel to each runway rail is located a pair of safety tongues 4 of which one is always inclined an angle relative to the lower flange 8 and firmly held in this inclined position. As illustrated particularly in FIG. 2, each safety tongue 4 is supported at the rear end thereof when viewed in the direction of the travel of the carriage as indicated by arrow A in FIG. 1, for rotation about an axis transverse to the runway rails 8*b*, whereas the front end of each tongue 4 is coupled to a lifting device of which only lifting rod 10 is shown. The lifting devices in each pair are mutually coupled to impart an oppositely directed tilting movement to both safety tongues 4**.

The overhead conveyor of this invention further includes a trolley carriage of which only a pair of rocking levers 1 and driving means 13 of an adjustment device are illustrated in FIG. 2 whereby for the sake of clarity the trolley's guiding rails and driving motor as well as the suspension of the carriage had been omitted. Both rocking levers 1 are arranged in a vertical plane one above the other and coupled together by a coupling rod 11 so that only one cylinder-piston drive 13 on the non-illustrated trolley is sufficient for tilting both levers 1 about axles 12 also provided on the trolley carriage. Both ends of each rocking lever 1 are provided with downwardly directed pivot pins for rotatably supporting guiding rollers 5. The ends of lower rocking lever 1 further support calotte-shaped or semispherical slide shoes **1*a* located below the lower guiding rollers 5 to pass the above the assigned safety tongue 4. In this manner one of slide shoes 1*a* during the advance of the trolley carriage engages the sloping surface of lifted safety tongue 4 and mechanically tilts both rocking levers 1 into their correct angular position independently from the actuation of driving member 13 so that the switching movement of guiding rollers 5 on both levers 1 is effected even in the event that false command or control signal which does not correspond to the desirbed direction of advance of the carriage, arrives to an adjustment unit (not shown) controlling the driving member 13. In addition, the ends of the upper rocking lever 1 are provided with roof-shaped noses 2 each with two opposite downwardly directed sloping surfaces 2*a* the length L of which is adjusted such that the sloping face 2*a* engages an assigned locking rail 3 at the moment when the diagonally opposed slide shoe 1*a* is still in engagement with the end edge of the inclined safety tongue 4 (FIG. 2). Furthermore, the angle of inclination of the sloping face 2*a* is dimensioned such as to impart during the forward movement of the trolley carriage the residual tilt to both rocking levers 1 so that a well defined effective engagement of switch guiding rollers 5 with guiding rails 9 is always guaranteed. The operation of the overhead conveyor system according to this invention in a track installation having switch points arranged in two opposite directions is possible without any modification of the switch point operating mechanism since the configuration of the roof-like safety noses 2 is symmetrical along a vertical plane transverse to slot 8***a* and the arrangement of slide shoes 1*a* is symmetrical about a vertical plane parallel to slot 8*a*.

Figure 3:
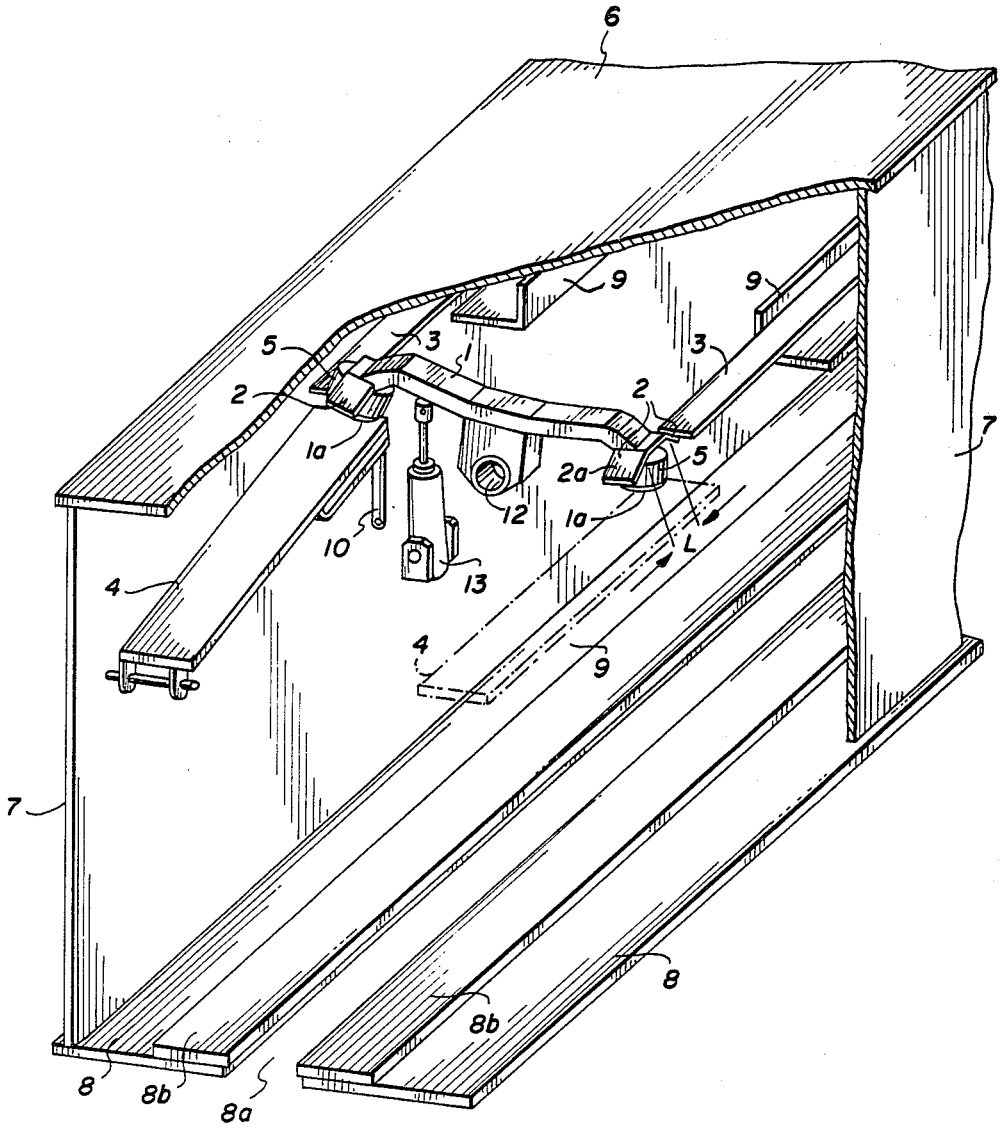
FIG. 3 is a view similar to FIG. 2 of another embodiment of this invention.
Figure 4:
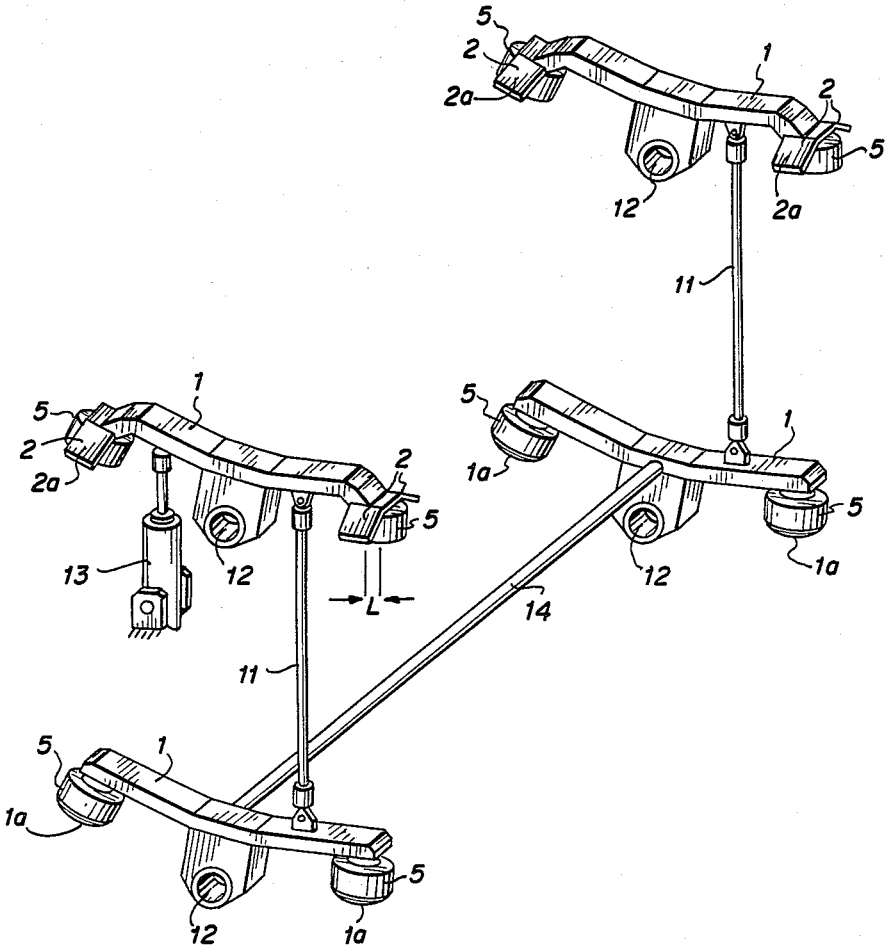
FIG. 4 shows in a perspective view a modification of the embodiment of FIG. 2.

It will be understood that each of the elements described above, or two or more together, may also find a useful application in other types of constructions differing from the types described above. For example, in a modification of this invention a sufficient stability of the trolley carriage in the range of a switch point can be achieved by providing the trolley carriage with only one rocking lever 1 arranged in the upper part of the track installation which is provided both with slide shoes 1*a* and with safety noses 2. In this case, it is necessary to arrange the tiltable safety tongues 4 at a higher level sufficient for engaging slide shoes in the upper rocking lever 1 (FIG. 3). In a still further modification of this invention suitable especially for trolley carriage of increased weight and designed for higher loads, there may be provided a series of successively arranged pairs of superposed rocking levers 1 and supported for rocking movement on axles 12 projecting from the end faces of the carriage (FIG. 4). This series arranged pairs of rocking levers can be driven by separate drives 13 and if only one drive is desired, they can be connected by longitudinal coupling tubes 14.

While the invention has been illustrated and described as embodied in a safety device for driving means to switch points in an overhead conveyor, it is not intended to be limited to the details shown, since various modifications and structural changes may be made without departing in any way from the spirit of the present invention.

What is claimed as new and desired to be protected by Letters Patent is set forth in the appended claims:

1. In an overhead conveyor including a track installation having at least one track switch point, a trolley carriage suspended on said installation and supporting a rocking lever, guiding rails and locking rails secured to said installation in the range of said switch point and at least two guiding rollers supported respectively on the ends of said rocking lever on said carriage to engage selected guiding rails in the range of said switch point, a combination comprising safety means for enhancing the switching operation in the range of said switch point, said safety means including an upwardly inclined tongue provided on said track installation before the range of said switch point below the path of movement of a guiding roller at one end of said lever; a slide shoe attached to said one end of the rocking lever to engage the sloping surface of said tongue to tilt said rocking lever about a predetermined angle; said locking rail being arranged for locking the second guiding roller at the other end of said rocking lever in its angularly displaced position; at least one safety nose attached to said other end of said lever above said second guiding roller, said nose being inclined downwardly in the direction of travel of said carriage and exceeding in length the radius of said second guiding roller to enter the effective range of said locking rail before said slide shoe disengages said tongue.

2. A combination as defined in claim 1, wherein said trolley carriage supports a pair of superposed rocking levers interconnected by a coupling rod, the lower lever supporting said slide shoes for cooperation with said tongues and the upper rocking lever supporting said roof-like nose.

3. A combination as defined in claim 2, wherein said trolley carriage supports a plurality of pairs of rocking levers arranged in series in the direction of said track installation, said levers being connected by a coupling tube and driven by a single driving means.

4. A combination as defined in claim 1, comprising a guiding roller at each end of said rocking lever, a slide shoe connected to the bottom of each guiding roller, a pair of inclinable tongues provided on said track installation below the path of movement of respective guiding rollers, and a pair of roof-like noses arranged on the ends of the rocking lever above said guiding roller.

5. A combination as defined in claim 4, wherein said carriage supports for rocking movement two rocking levers arranged one above the other and joined together by a coupling rod, said slide shoes being attached to the ends of the lower rocking lever and said safety noses being arranged on the ends of the upper rocking lever, the sloping surfaces of said noses being symmetrical about a vertical plane intersecting said rocking levers.

6. A combination as defined in claim 5, wherein each of said slide shoes is in the form of a calotte having its curved surface directed to the assigned tongue.

7. A combination as defined in claim 4 wherein said slide shoes are mounted below said guiding rollers.

* * * * *